US010814949B1

(12) United States Patent
Hawkes

(10) Patent No.: US 10,814,949 B1
(45) Date of Patent: Oct. 27, 2020

(54) SUBMERSIBLE VEHICLES

(71) Applicant: Graham Sidney Hawkes, Point Richmond, CA (US)

(72) Inventor: Graham Sidney Hawkes, Point Richmond, CA (US)

( * ) Notice: Subject to any disclaimer, the term of this patent is extended or adjusted under 35 U.S.C. 154(b) by 0 days.

(21) Appl. No.: 16/202,161

(22) Filed: Nov. 28, 2018

Related U.S. Application Data

(60) Provisional application No. 62/592,115, filed on Nov. 29, 2017.

(51) Int. Cl.
*B63G 8/08* (2006.01)
*B63G 8/22* (2006.01)
*B63G 8/18* (2006.01)

(52) U.S. Cl.
CPC ..... *B63G 8/08* (2013.01); *B63G 8/18* (2013.01); *B63G 8/22* (2013.01); *B63B 2702/10* (2013.01); *B63B 2702/12* (2013.01)

(58) Field of Classification Search
CPC ..... B63G 8/08; B63G 8/18; B63G 8/22
See application file for complete search history.

(56) References Cited

U.S. PATENT DOCUMENTS

| | | | | |
|---|---|---|---|---|
| 3,865,060 | A * | 2/1975 | Bastide | B63C 11/42 114/332 |
| 5,237,952 | A * | 8/1993 | Rowe | B63B 11/04 114/332 |
| 7,131,389 | B1 * | 11/2006 | Hawkes | B63G 8/001 114/330 |
| 9,522,718 | B2 * | 12/2016 | Hawkes | B63G 8/16 |
| 9,944,371 | B2 * | 4/2018 | Hawkes | B63G 8/16 |
| 10,000,264 | B2 * | 6/2018 | Sheard | B63G 8/001 |
| 10,071,792 | B2 * | 9/2018 | Montousse | B63C 11/46 |
| 2016/0214693 | A1 * | 7/2016 | Habeger | B63C 11/52 |

* cited by examiner

*Primary Examiner* — S. Joseph Morano
*Assistant Examiner* — Jovon E Hayes
(74) *Attorney, Agent, or Firm* — Thomas G. Ference

(57) ABSTRACT

A water submersible vehicle, the vehicle has a variable buoyancy system where flight of the submersible is controlled by a forward thruster forward of the center of displacement and that regulates both pitch and up-and-down hover. The vehicle in combination with a control system allows the user using to use only two control elements, one with each hand, to fly the vehicle by controlling motion along long axis, yaw, pitch and roll. An ergonomic submersible pod may be incorporated into the water submersible vehicle. The ergonomic submersible pod may also be used with other flight systems to provide for new types of low cost underwater travel.

36 Claims, 17 Drawing Sheets

Pitch Angle $\underbrace{T_P \bullet FD}_{\text{Pitch Movement}} = \underbrace{W \bullet \sin A \bullet X_{BG}}_{\text{Restoring Movement}}$ Long Axis Movement $M_L = T_{LM} + T_{LF}$ Buoyancy $B = D - W$ Vertical Movement $M_V = T_{VM} + T_{VF} + B$ Controlling Yaw Controlling roll Wing Fin

SUBMERSIBLE VEHICLES

RELATED APPLICATIONS

This application claims the benefit of priority of U.S. Provisional Patent Application No. 62/592,115, filed on Nov. 29, 2017, the disclosure of which is herein incorporated by reference. This patent application is also related to U.S. Design patent application No. 29/627,769, filed on Nov. 29, 2017, and entitled "Ergonomic Submersible Pod", the disclosure of which is incorporated herein by reference.

FIELD

The present invention generally relates to water submersible vehicles. More specifically, the invention relates to a water submersible vehicle having a variable buoyancy system and where flight of the submersible through water is controlled by a forward thruster that is forward of the center of displacement and that regulates both pitch and up-and-down hover. An ergonomic submersible pod may be incorporated into the water submersible vehicle. The ergonomic submersible pod may also be used with other submersible systems to provide for new types of low cost underwater travel.

BACKGROUND

The concept of underwater vessels has been around for hundreds of years. Today most underwater vessels are military submarines that are completely autonomous and can travel long distances without surfacing. A different class of underwater vessels, submersibles (a.k.a. sub) requires a "mother" ship for transport to and from the dive site and for operational support. These subs are generally smaller than submarines. In the entire world today, there are only approximately one hundred fifteen active submersibles plying the oceans. The main deterrent to the use of submersibles is that they are expensive to operate primarily because of the cost of the mother ship.

The first subs to be used for commercial work were what are now called common subs. Common subs are designed primarily to resist external pressure and so are usually spherical or cylindrical with poor human ergonomic accommodations such as poor and distorted outside vision and lack human comfort. In addition, because common subs are slow with limited range they must rely on costly support from a mother ship.

A major modern advancement was the development of underwater flight. Underwater flight is defined as thrust and motion only along the long axis of a vessel, using pitch to control and change depth. Winged subs provide for underwater flight taught in U.S. Pat. No. 7,313,389 to Hawkes, which is incorporated herein by reference. Winged subs have proven to solve the primary deficiency of common subs because of their greater travel range they can eliminate the costly mother ship whenever they can be supported from shore. Winged subs are safer as they have a fixed positive buoyancy and automatically float back to the surface. These winged subs, however, suffer the deficiency that unlike common submersibles they cannot hover and without variable ballast (or buoyancy) they cannot develop sufficient freeboard to change out personnel at sea. For personnel changes these winged subs still need to be brought onto a mother ship or to shore. Winged subs proved also to need more skill to fly attributed to needing simultaneous control over four rather than three degrees of freedom, these four degrees of freedom being both an advantage to those who enjoyed the new sport of "underwater flight" and a disadvantage to more casual participation.

Another recent advancement has been the use of relatively large vertical thrust, using multiple vertical thrusters and auto balancing electronic control to hold them accurately horizontal in both pitch and roll to avoid unwanted motion. These vertical thrust submersibles overcome the deficiency of winged subs and are able to hover, while being simple to use and retaining the safety of fixed positive buoyancy. Vertical thrust subs are taught in U.S. Pat. No. 9,522,718 to Hawkes, which is incorporated herein by reference. Like winged subs these eliminated variable buoyancy using vertical down thrust to overcome their fixed positive buoyancy and proved to be simple to operate for the pilot provided they used autopilot to maintain precise horizontal attitude. However, vertical thrust submersibles have compromised range as they are not streamlined in one axis as is typical for winged subs. Also, their vertical thrusters consume significant energy just to hold depth. Hence their speed and range is compromised and they suffer the deficiency of common subs in needing costly support form a large surface vessel.

In summary, the deficiencies of common submersible are dependence on mother ships, poor maneuverability and discomfort for human occupants. The deficiencies of winged subs are inability to hover and change out personnel while at sea. The deficiencies of hover subs are the excessive cost of mother ship and inability to change personnel at sea.

The present invention aims to eliminate the deficiencies of these prior submersibles while retaining their best attributes.

SUMMARY

In one implementation, the present disclosure is directed to a water submersible vehicle. The water submersible vehicle comprises a body having a center of gravity, center of buoyancy and a long axis. The vehicle further includes a forward thruster located forward of the center of buoyancy and providing thrust substantially perpendicular to the long axis. The vehicle further includes at least one main thruster located to provide propulsion thrust along the long axis. The pitch and depth of the vehicle is controlled by the forward thruster, an easy translation for the pilot between flight and hover modes, because since the same control is used in the same sense to control depth (up and down) both at speed while flying and while hovering.

In another implementation, the present disclosure is directed to a method of operating a water submersible vehicle. The method comprises providing a submersible body having a center of gravity, center of buoyancy and a long axis, the center of buoyancy and center of gravity are a distance $X_{DG}$ apart. The method further comprises providing a forward thruster located forward of the center of buoyancy and providing thrust substantially perpendicular to the long axis, the forward thruster is forward of the center of buoyancy by a fixed distance FD. The method further comprises at least on main thruster located to provide thrust along the long axis. The method still further comprises providing a control system having first and second control elements. The method further comprises adjusting the pitch angle A of the vehicle by adjusting the magnitude of thrust of the forward thruster.

In yet another implementation, the present disclosure is directed to a water submersible vehicle for holding a human body having eyes. The water submersible vehicle comprises a pod having a body portion and a viewing dome. The pod has walls that define an interior and an exterior. A seal exists between the body portion and the viewing dome. The water submersible vehicle further includes a latching system for displacing the viewing dome from the body portion of the submersible to allow the human body entry into and out of the submersible pod. The pod is bean-shaped to minimize volume of the pod to conform to the shape of a human body seated in a relaxed recumbent position within the pod while at the same time providing for low frontal viewing area and good hydrodynamic flow around the submersible pod. The body portion of the submersible has a centerline. The centerline has a radius of curvature. The shell diameter increases from the foot end to the seal end. The pod is configured so that a user's eyes are close to the center of curvature of the viewing dome, this gives the best view forwards and upwards, while rolling the craft provides the best view to the side and downwards.

BRIEF DESCRIPTION OF DRAWINGS

For the purposes of illustrating the invention, the drawings show aspects of one or more embodiments of the invention. However, it should be understood that the present invention is not limited to the precise arrangements and instrumentalities shown in the drawings, wherein.

DETAILED DESCRIPTION

The use of the terms right and left in this disclosure are understood to represent the starboard and port sides of submersible vehicle 30.

Figure 1:
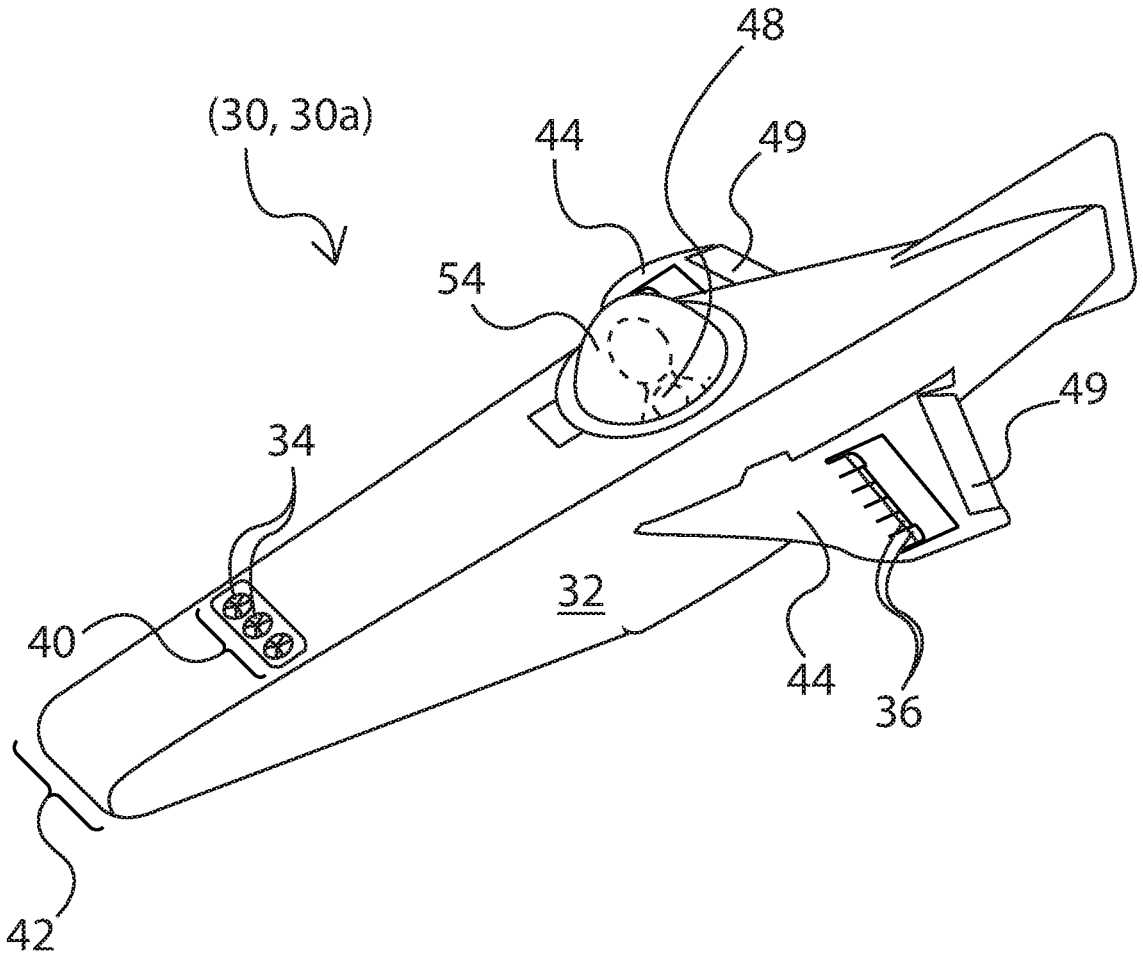
FIG. 1 is a perspective view of one exemplary embodiment of a water submersible vehicle according to the present invention.
Figure 2:
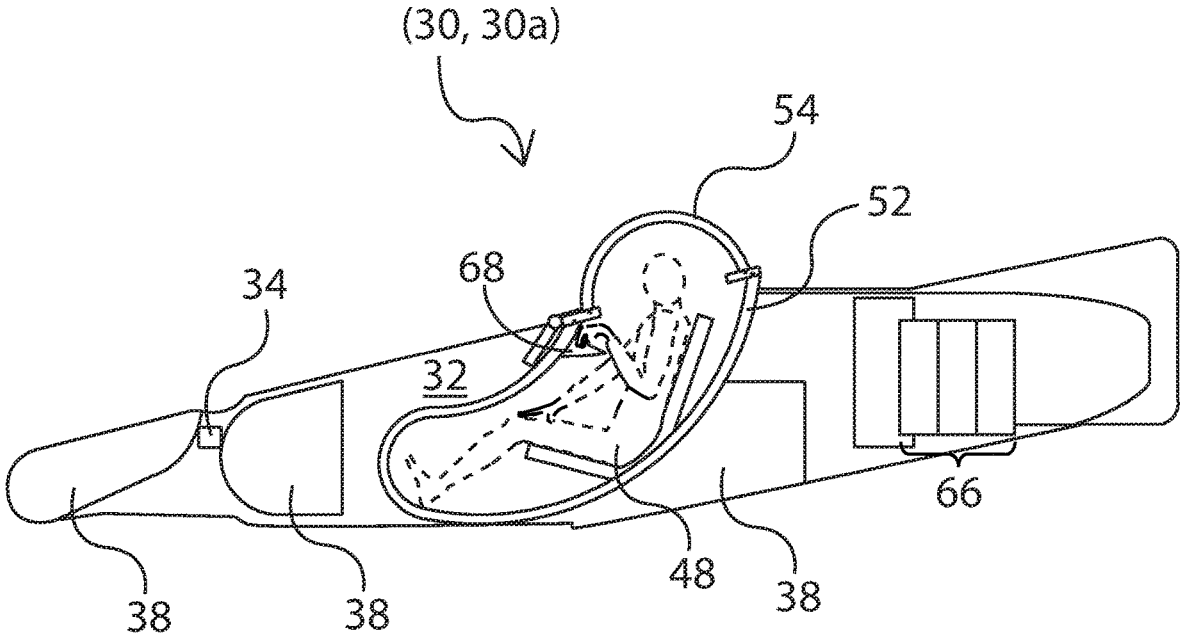
FIG. 2 is a side-sectional view of the submersible vehicle in FIG. 1.
Figure 3:
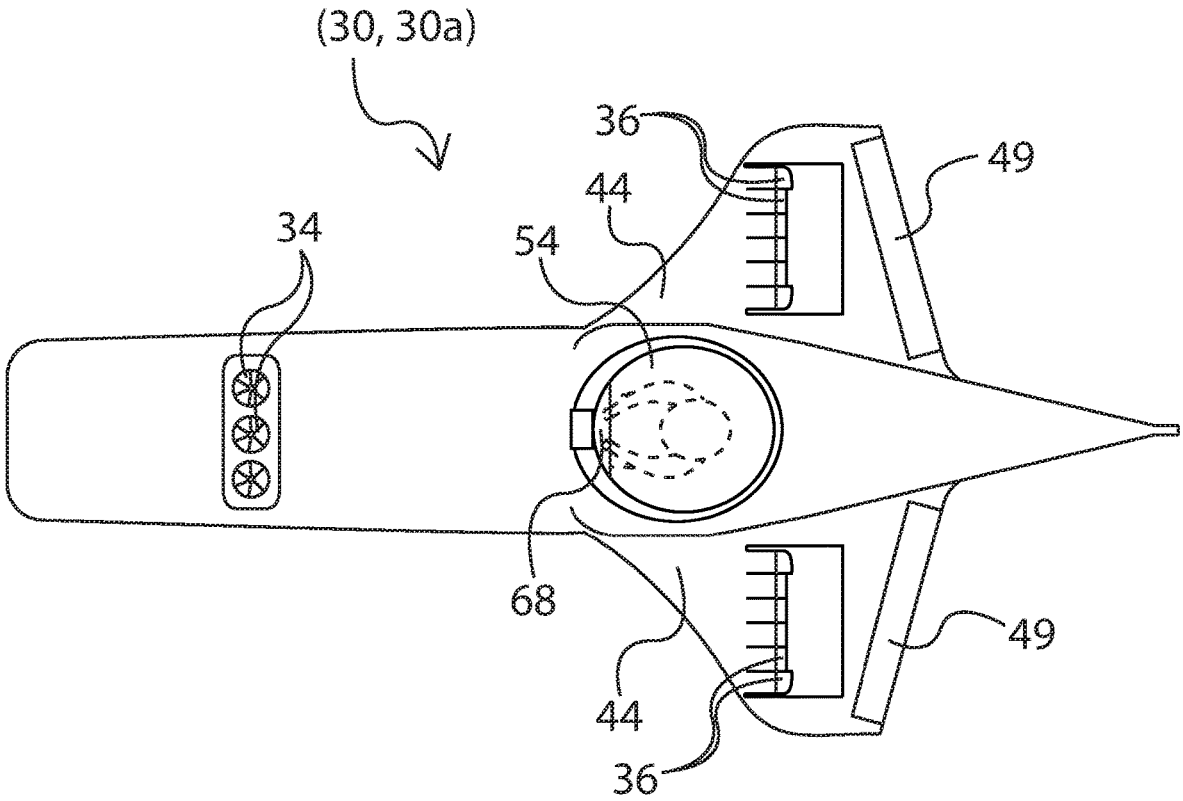
FIG. 3 is a top view of the submersible vehicle in FIG. 1.

Water submersible vehicle 30 (a.k.a. sub) is illustrated in FIGS. 1-17. Vehicle 30 comprises a body 32 having a center of gravity, center of buoyancy and long axis L. Body 32 may be covered with a hydrodynamic shell. Vehicle 30 further comprises a forward thruster 34 located forward of the center of buoyancy and providing thrust substantially perpendicular to long axis L to control pitch, FIGS. 1-3. Vehicle 30 further comprises at least one main thruster 36 located to provide propulsion thrust along long axis L. Main thruster 36 may be integrated with wings 44 and/or integrated with the hull. Vehicle 30 may further include a variable buoyancy 38 system such as air and water filed tanks. Vehicle 30 may include a lift slot 40 in which forward thruster 34 is contained. Vehicle 30 may have a wedge-shaped nose 42 that is wide in a direction perpendicular to the lift slot. Vehicle 30 may have right and left side wings 44 or fins 46 to control roll motion. Vehicle 30 has one or more watertight chambers, one chamber of which is an occupant chamber for holding occupant 48 preferably held at one atmosphere within.

Figure 4:
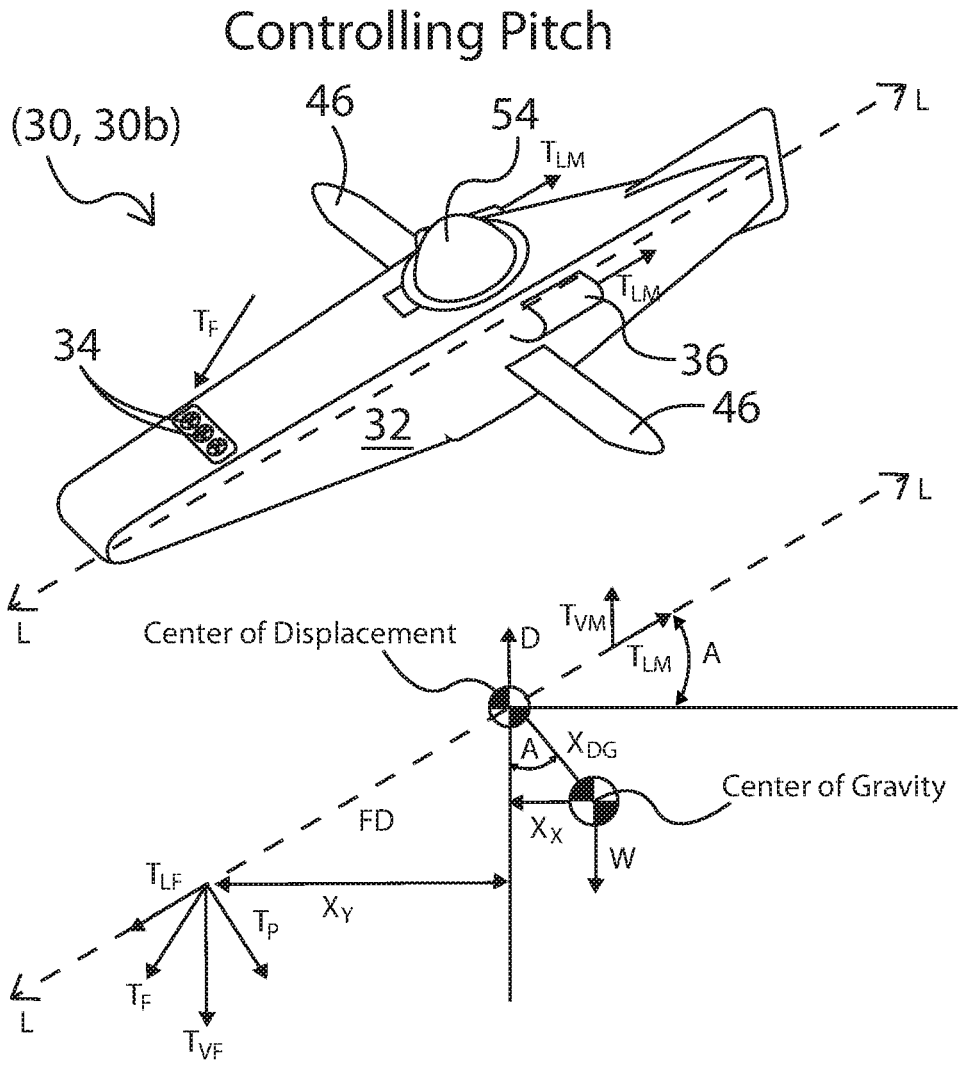
FIG. 4 is a schematic diagram illustrating operational physics for adjusting pitch of the submersible vehicle of FIG. 1.
Figure 5:
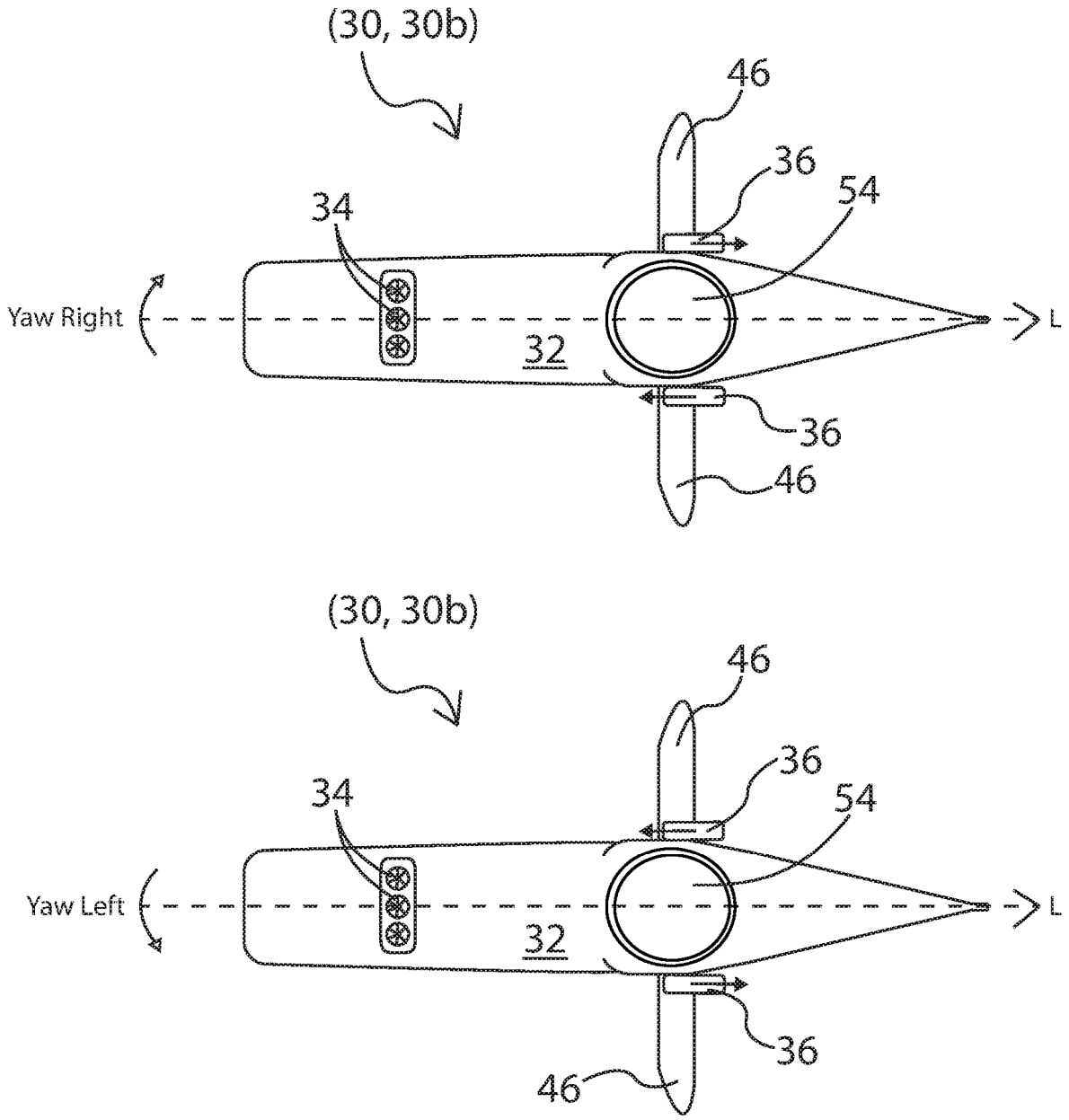
FIG. 5 is a schematic diagram illustrating operational physics for adjusting yaw of the submersible vehicle of FIG. 1.
Figure 6:
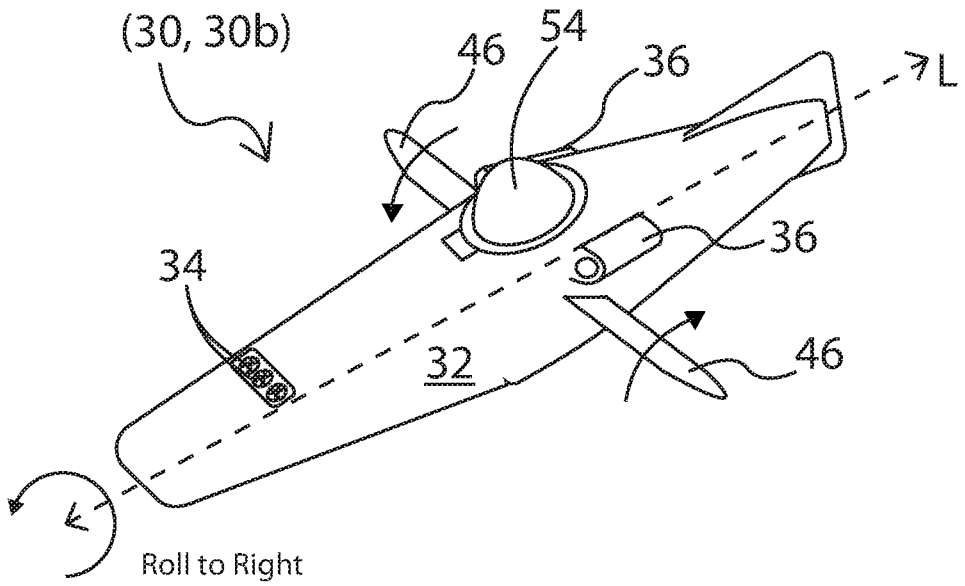
FIG. 6 is a schematic diagram illustrating operational physics for adjusting roll of the submersible vehicle of FIG. 1.
Figure 6:
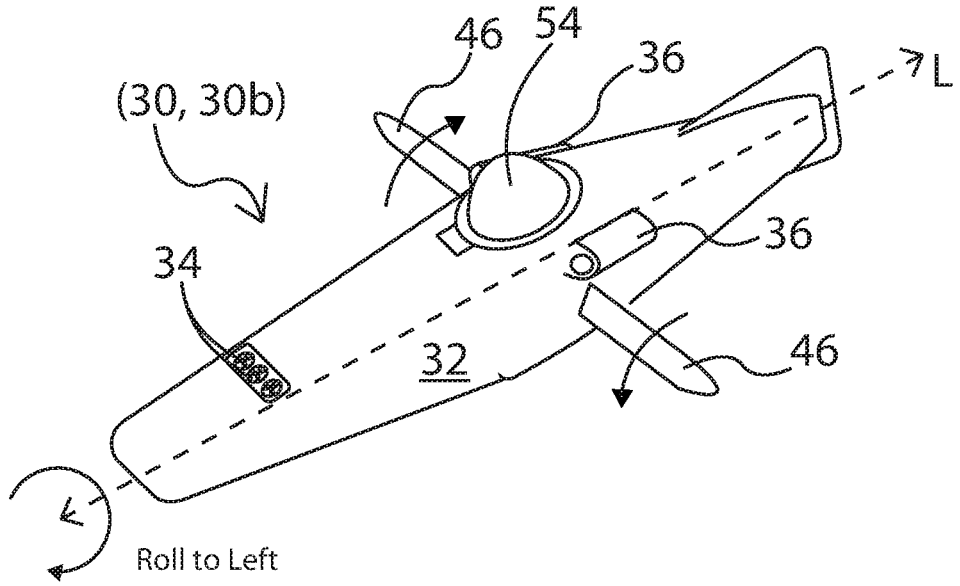

The operational physics for vehicle 30 is shown in FIGS. 4-6. For controlling pitch, FIG. 4, forward thruster 34 is positioned a distance FD forwards of center of displacement. The vertical up and down force of $T_F$ (thrust) controls the pitch of vehicle 30. Thus forward thruster 34 acts as a "canard" or forwards control surface; this is similar in effect to an "elevator" at the rear of an aircraft in flight in 3-dimensional space. The pitch moment will be $T_p$*FD. Vehicle 30 of displacement D and mass M (and thus weight W) and such that the center of displacement ($C_D$) is above center of Mass ($C_M$) by a minimum distance ($X_{DG}$) specified by design or ABS (American Bureau of Shipping) minimum (or similar certification design rules). Vehicle 30 will have a natural restorative moment so that if displaced in pitch or roll to angle $A^0$, the restorative moment is W*Sin A*$X_{BG}$. Vehicle 30 will naturally rotate and stabilize in pitch coming to rest at angle A when $T_F$*FD=W*Sin A*$X_{DG}$. Thus when in motion the path of the craft (when substantially at neutral buoyancy achieved variable buoyancy system 38) will essentially follow the path at pitch angle A to the horizon. Forward thruster(s) 34 provide simple near vertical force to finely control depth directly by simply moving the craft vertically up or down while hovering or at very low to stationary forwards speed when the craft is close to neutral buoyancy achieved by variable buoyancy system 38. Main thruster(s) 36 will primarily generate forward and backward speed. Any component of thrust from forward thruster 34 along axis L will add or subtract speed from forward component of thruster(s) 36.

If main thruster 36 is a pair of main thrusters, the main thruster can be used to control yaw. For controlling yaw, FIG. 5, a main thruster 36 is a pair of main thrusters. Having less forward thrust in the right thruster than the left thruster will generate yaw right. Having more forward thrust in the right thruster than in the left thruster will generate yaw left. Thus a vehicle can be aimed in 3-dimensional space by the pilot controlling pitch and yaw. This type of controlled motion in 3-dimensional space can be said to be "flight".

For controlling roll, FIG. 6, fins 46 may be provided. The pilot controls the angle of attack of the fins or ailerons, typically so that one side generates dynamic lift force in the opposite direction to the other side so that the pair cancel each other out and generate no net lift force, only a rotational moment that initiates and controls roll.

Figure 7:
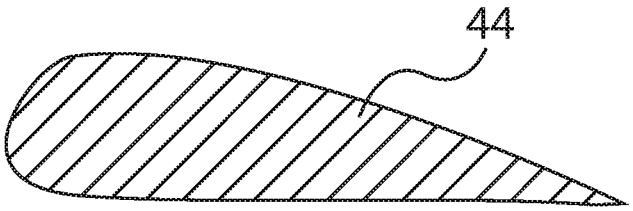
FIG. 7 is a sectional view illustrating wing and fin structures that may be used with the vehicle of FIG. 1.
Figure 7:
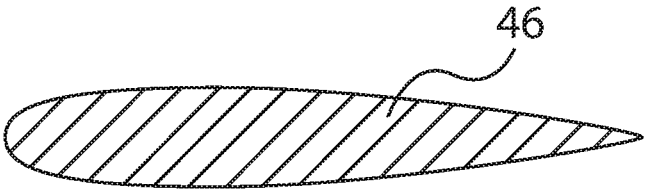

Cross-sections of wings 44 and fins 46 are shown in FIG. 7 The distinction between a wing 44 and a horizontal fin 46 is typically that a "wing" has a ((National Advisory Committee for Aeronautics) NACA type) non symmetrical LIFT cross section and its purpose is to providing a dynamic lift force which increases with speed. A wing typically has a fixed "angle of attack" set at optimum efficiency (minimum drag for designed lift force, so typical angle of attack is about +2 degrees). Both aircraft and winged subs use wings. In the case of aircraft, wings are used to counter the total weight of the aircraft, while "winged subs" have an inverted lift foil to counter only a fixed positive buoyancy force and hold the sub submerged at cruise speed (about 3 knots) against its fixed positive buoyancy (fixed positive buoyancy is typically about 4% of displacement). Whereas fins (whales, dolphins have fins) typically have neutral or symmetrical cross section and thus do not develop lift at zero angle of attack and are used primarily (optimized) for control, so that dynamic lift force either +/− is produced by changing angle of angle of attack: either plus or minus. Note fins can be fully articulating or the forward portion can be fixed and the aft portion hinged for structural advantage with the rear portion hinged and articulated to produce the desired controlling force. Such movable sections called ailerons 49 are typically on aircraft and wings of winged subs. Thus, a rudder is a fin not a wing and whales and dolphins have fins not wings. The winged sub has wings with (inverted NACA lift section to pull the positively buoyant sub down) whereas the new sub has symmetrical cross section or horizontal fins either fully articulated or part fixed and hinged. All that said, fins with angle of attack can produce lift but less efficiently than a wing, but have the advantage over a wing operating with minimal drag when no control force is wanted at zero lift (zero angle of attack) and in that mode a fin is more efficient than a wing. Thus "winged subs" have wings set at a negative angle of attack opposite to that of aircraft, while the new sub has horizontal fins like a humpback whale.

Vehicle 30 is preferably has a variable buoyancy system 38 or ballast system that provides net positive buoyancy for safety, the vehicle will surface if something goes wrong and it loses power. Variable buoyancy system 38 is used to provide sufficient surface floatation to increase freeboard for improved surface visibility for safe surface maneuvering and to enable the crew to safely open hatch(s) and enter or exit the craft on the surface in calm conditions. Ballast tanks and VB (variable buoyance) systems are in general difficult to control, they are typically unstable and so can be accurately trimmed at only one depth only (pressure depth) forcing the pilot to make constant adjustments. Thus, the common use of vertical thrust to overcome small errors in VB trim allowing the pilot to maintain desired depth. Note, another control problem for the pilot is that buoyancy changes using VB are slow and difficult to judge so again vertical thrust is used to give instantaneous and easy depth control. Therefore a pilot will typically use VB system to approximate submerged neutral buoyancy (say to within +/−1% of displacement) and then use vertical thrust for fine control to move up or down or actually hover. The new sub uses a variable buoyancy system to approximate neural buoyancy then when moving uses pitch to control depth with the craft generating dynamic forces on its body like a winged sub in flight and once hovering uses the near vertical thrust to directly move the sub up or down like a common sub while hovering.

Water submersible vehicle 30 includes a control system. Control system may include a first control element and a second control element; each control element controls one or two motions from the group consisting of the simultaneous needed control of four motions that make flight. These are: thrust along long axis and rotation in yaw, pitch and roll. However the control system can block rotation in roll (which is optional) and thus simplifies piloting skill to that of a three simultaneous control functions only, while still enabling efficient flight and hover.

The preferred method of control is by small electronic hand joysticks similar to those used to control aircraft where electronic control or fly-by-wire is used. Typically, these are simple two axis joysticks. Note, one type of control element has its output proportional to displacement from its center and another type has its output controlled and proportional to the force exerted upon the control element by the pilot.

The electronic control output from the pilot's control elements becomes the input to the amplifiers. Note this in turn may require some electronic conditioning to match scale or impedance and/or desired mapping. Hence the pilot's electronic control output in turn controls the thruster's output (force). Or the pilots electronic control output may in turn control movement of control surfaces (fly by wire). For example, roll is typically controlled by side-to-side displacement or pressure of a joystick that in turn controls the displacement of wings effecting roll. The resulting motion of the vehicle in response to any control input by the pilot is called "mapping." The goal of mapping is to create "instinctive" pilot control over the vehicle. Such pilot electronic controls typically have electrical output that is +/−5 volts with zero output at the controls center and such controls are typically sprung to return to center with zero output when no pilot input. Thus, fore and aft motion or pressure of a joystick can be mapped to control all fore and aft main thrust for forwards speed or can control vertical thrust to control pitch/vertical motion.

In a preferred arrangement, two two-axis hand joysticks, one for the left hand and one for the right hand are used giving the pilot control over four independent functions. In the preferred mapping arrangement, the left-hand joystick moved fore and aft will control forwards (long axis thrust) equally on both left and right side thrusters and thus speed both forwards and reverse. Side-to-side displacement of the left-hand joystick will independently control left and right thruster amplifiers and therefore thrust force on either side of the submersible. This joystick maneuver controls the vehicle's yaw whether the vehicle is moving or not.

In this preferred arrangement fore and aft displacement of the right-hand electronic joystick control will control forward vertical thrust and thus pitch when moving. However, when forward motion is stopped and the submersible is stationary controlling the vertical thrust will directly control vertical motion. While left and right or side-to-side displacement of the right-hand joystick will in the preferred mapping arrangement control the differential angle of attack of the right and left wings. Thus, moving the control to the right causes the right wing to dive and the left wing to lift, thus rolling the vehicle to the right. The roll control will have no effect when the vehicle is stopped.

The electrical output of each axis of the OEM (original equipment manufacturer) electronic hand joysticks are typically compatible with OEM control amplifiers controlling thruster motors and amplifiers controlling displacement of control surfaces. Note, displacement of wing surfaces proportional to the pilot's input typically requires measuring the displacement of the control surface with feedback to the control amplifier.

Movement or control of various submersibles is represented in the standard six degrees of freedom, which is movement along the specified axis (x, y, z) or rotation about that axis. Nomenclature of air flight is used for flight underwater so that the degrees of rotational freedom said to be: yaw, pitch and roll. The inventor has found that degree of difficulty or skill or training needed for various types can be reduced simply to the number of functions the pilot must manage simultaneously. From experience three functions are readily managed while four require more training. Thus, common submersibles have three pilot functions: 1) yaw, 2) forwards and backwards thrust or motion 3) up and down thrust and motion. Thus, two are motion along an axis and only one rotation (yaw), whereas flight in air or underwater can be defined as needing four pilot simultaneous control functions. These functions are: motion along its long axis and full three rotation functions about yaw, pitch and roll.

Table 1 shows which of the six degrees of freedom each type of submergible has.

TABLE 1

Different Types of Essential Submersible Control Functions

| | Yaw | Pitch | Roll | VB* | Long Axis Thrust | Vertical Thrust | Lateral Thrust |
|---|---|---|---|---|---|---|---|
| Prior Designs | | | | | | | |
| Common Sub | YES | No | No | YES | YES | YES | Optional |
| Winged Sub | YES | YES | YES | No | YES | No | No |
| Thruster Sub | YES | No | No | No | YES | YES | No |
| Current Invention | | | | | | | |
| Hover & Basic Flight | YES | YES | No | YES | YES | No | No |
| Hover & Flight | YES | YES | YES | YES | YES | No | No |

*Note VB (variable buoyancy) is not required to be simultaneously controlled and is not considered in assessing pilot skill required.

Thus a submersible is able to use the same pilot controls in both "flight" and "hover" modes and at any speed for depth or pitch, heading and velocity. And a submersible is able to transition smoothly from controlled hover to controlled flight and from controlled flight back to controlled hover. In overall operation, the sub can be flown underwater as if a winged sub, but when at slow speed, below stall speed, the pilot will more carefully adjusts variable buoyancy to be near neutral and then using the same pitch or depth control adjusts forwards near vertical thrust to move the craft up or down. Also while below flight mode speed yaw is controlled by differential thrust (along long axis) as so is effective at zero speed also, where as a rudder as used on aircraft or winged sub to control yaw would not be. Hence while hovering the pilot has control over forward and rearward motion, yaw and depth and so can hover in place under full control. Note, while controlling the forward near vertical thruster the pitch of the craft is also changed but intuitively as wanted. Meaning to descend the nose will pitch further down giving the pilot a better downwards view all as wanted.

In one embodiment water submersible vehicle 30 may include an ergonomic submersible pod 50. Pod 50 has a body portion 52 and a viewing dome 54. Pod 50 has walls defining an interior 56 and exterior 58. A seal 60 exists between body portion 52 and viewing dome 54. Pod 50 is a water-tight chamber which is an occupant chamber for holding occupant 48 preferably held at one atmosphere within. O-ring type seals 62 may exist between body portion 52 and seal 60. O-ring type seals 62 may exist between viewing dome 54 and seal 60. Seal 60 may create a direct seal between body portion 52 and viewing dome 54. Pod 50 further includes a latching system 64 for displacing the viewing dome 54 form body portion 52 to allow a human body entry into and out of the pod. Latching system 64 may also create the force for securing at a pressurized seal between viewing dome 54 and body portion 52.

Pod 50 is generally a bean-shaped pod. Bean-shaped pod minimizes volume of the pod to conform to the shape of a human body seated within the pod and at the same time provides for good hydrodynamic flow around the submersible. Body portion 52 is generally a truncated bean-shaped shell. The "bean shape" is created by body portion having a centerline C. The center line C has a radius of curvature Rc. In one embodiment radius of curvature Rc is a constant. Radius of curvature Rc is in the range of 20-80 inches. Body portion 52 has a shell with shell length, shell diameter, shell thickness, and seal end and a foot end. Shell diameter increases from the foot end to the seal end to aid in manufacture and provide more ergonomic interior space for a human. The shell length is in the range of 1:3 to 1:4. The shell thickness from the foot end to the seal end may increase along the front of body portion 52.

Figure 8:
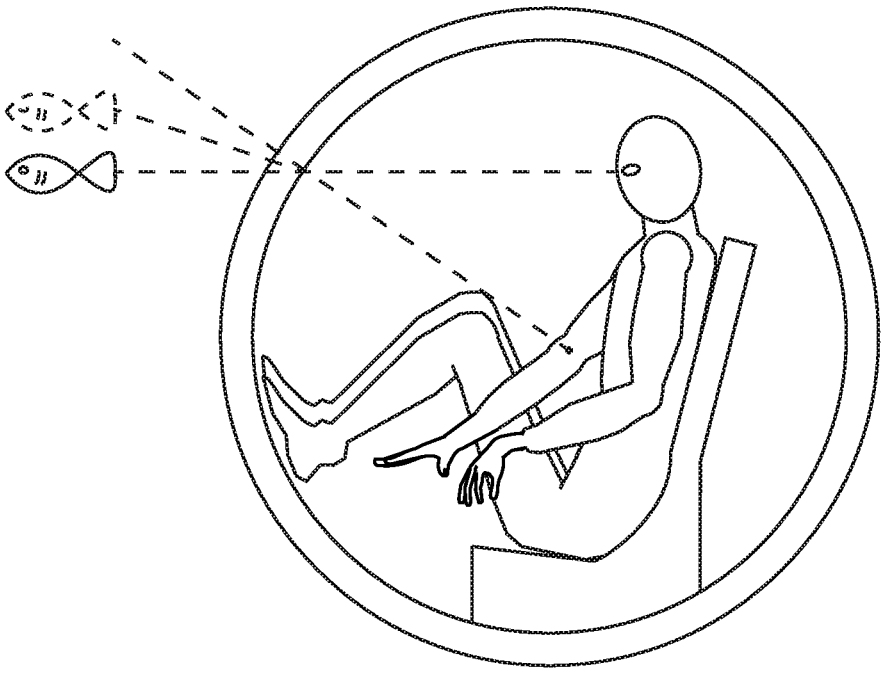
Figure 8 Prior Art
FIG. 8 is a side-sectional view of a prior art compartment for holding a person within a submersible vehicle.
Figure 9:
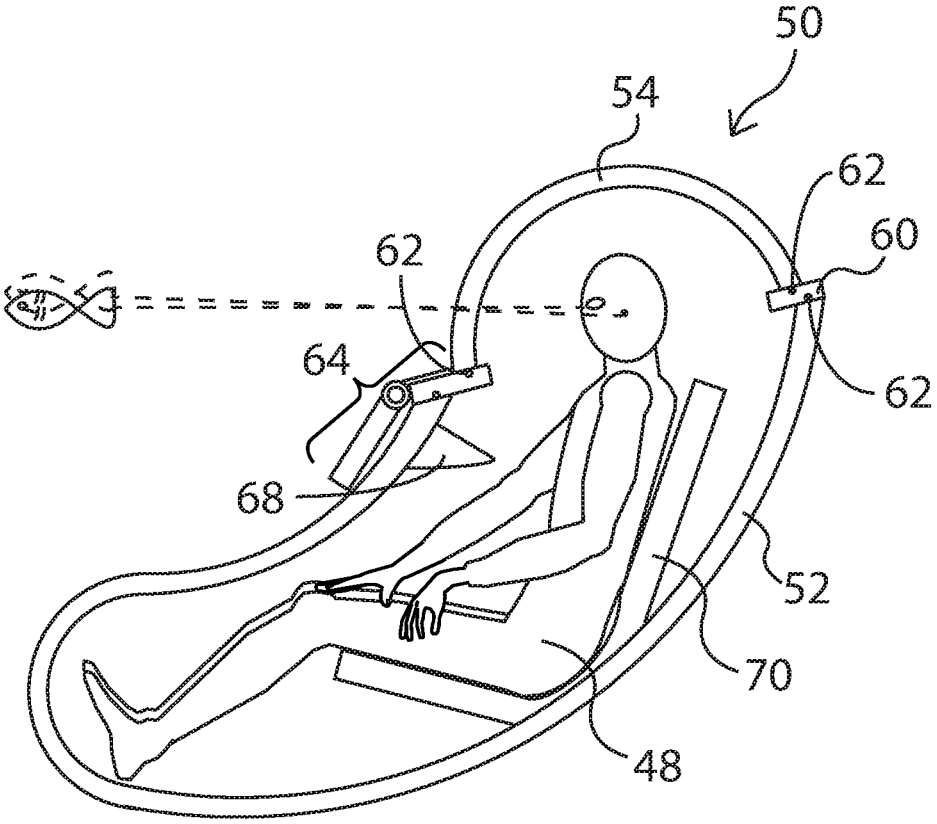
FIG. 9 is a side-sectional view of a pod for holding a person in a submersible according to the present invention, the pod can be used in conjunction with the submersible vehicle of FIG. 1 or incorporated into other submersible vehicle designs.
Figure 10:
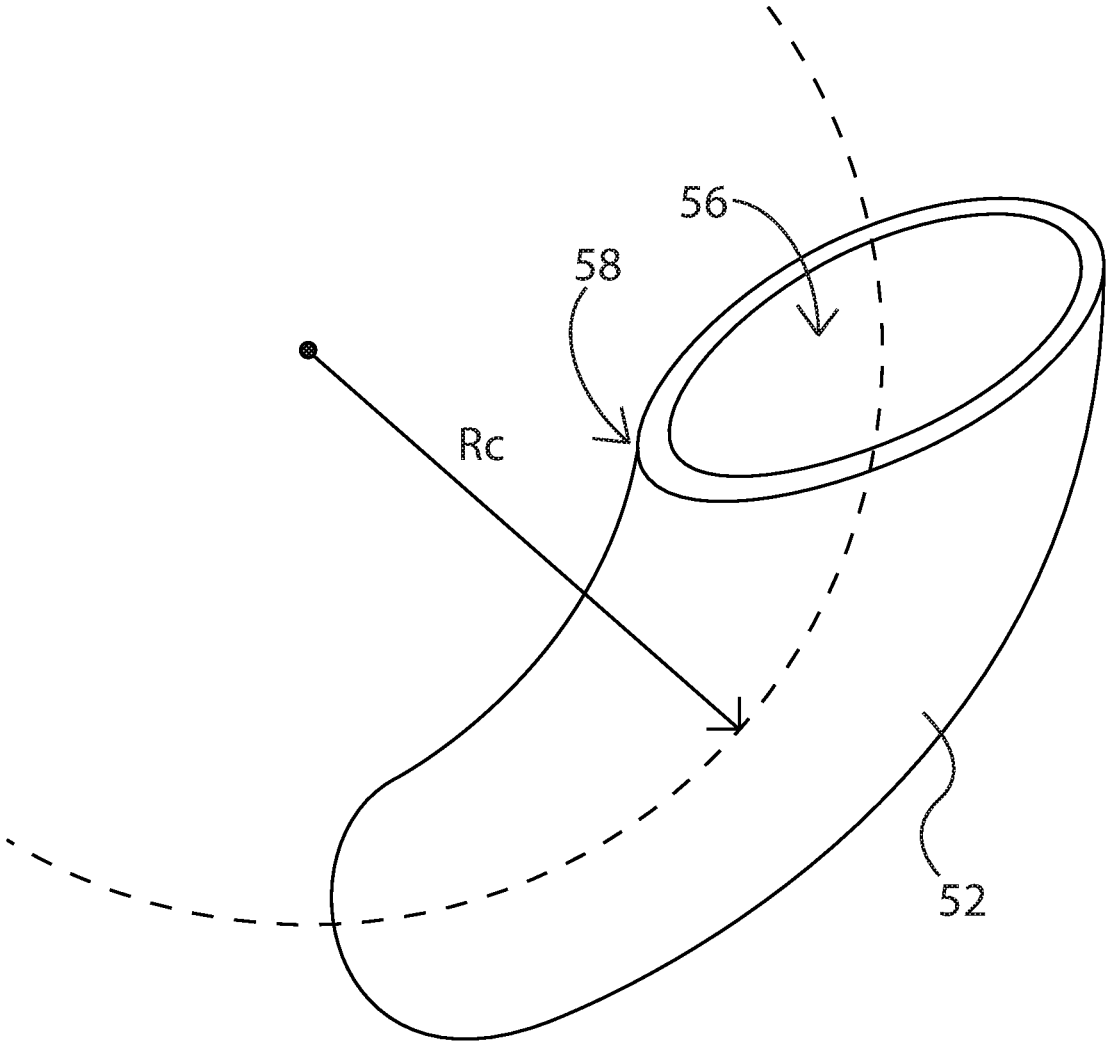
FIG. 10 is a perspective view of the pod in FIG. 9 showing the body portion having a truncated bean-shaped shell.
Figure 11:
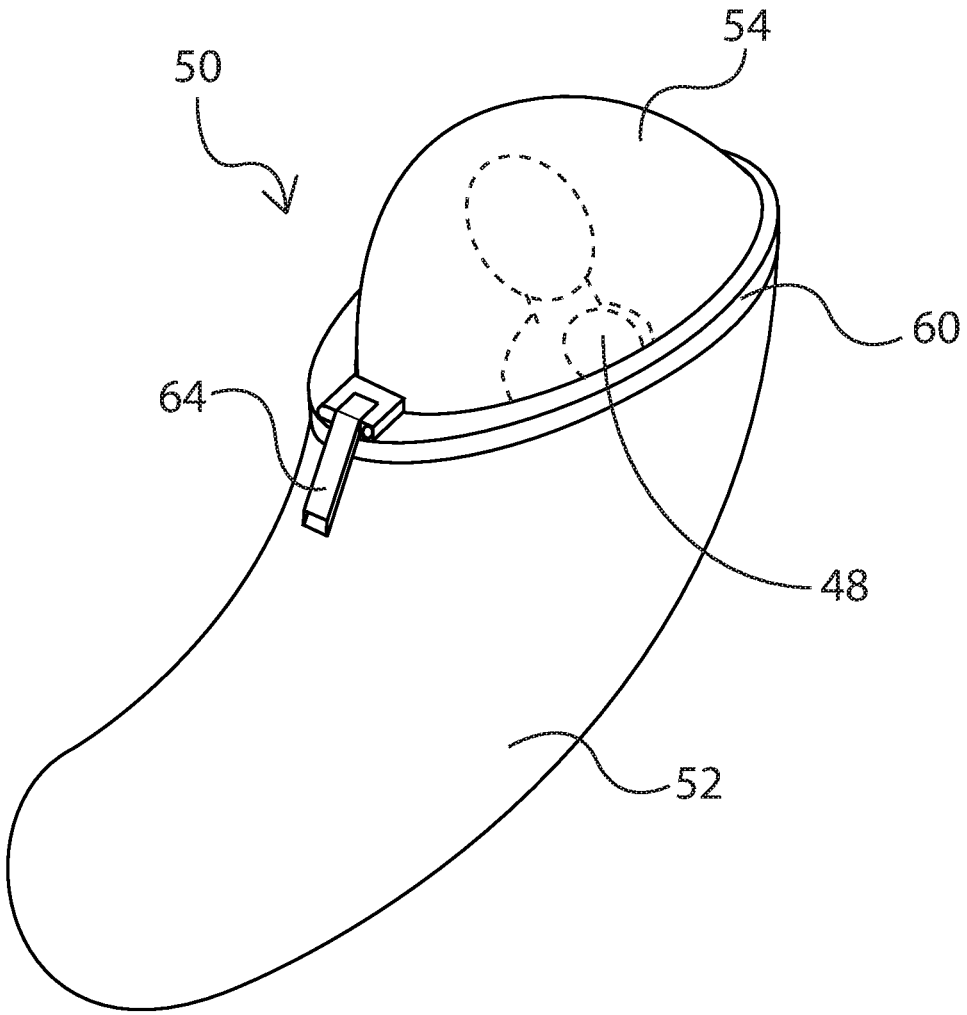
FIG. 11 is a perspective view of the pod in FIG. 9 showing the body portion integrated with viewing dome, seal and latch.
Figure 12:
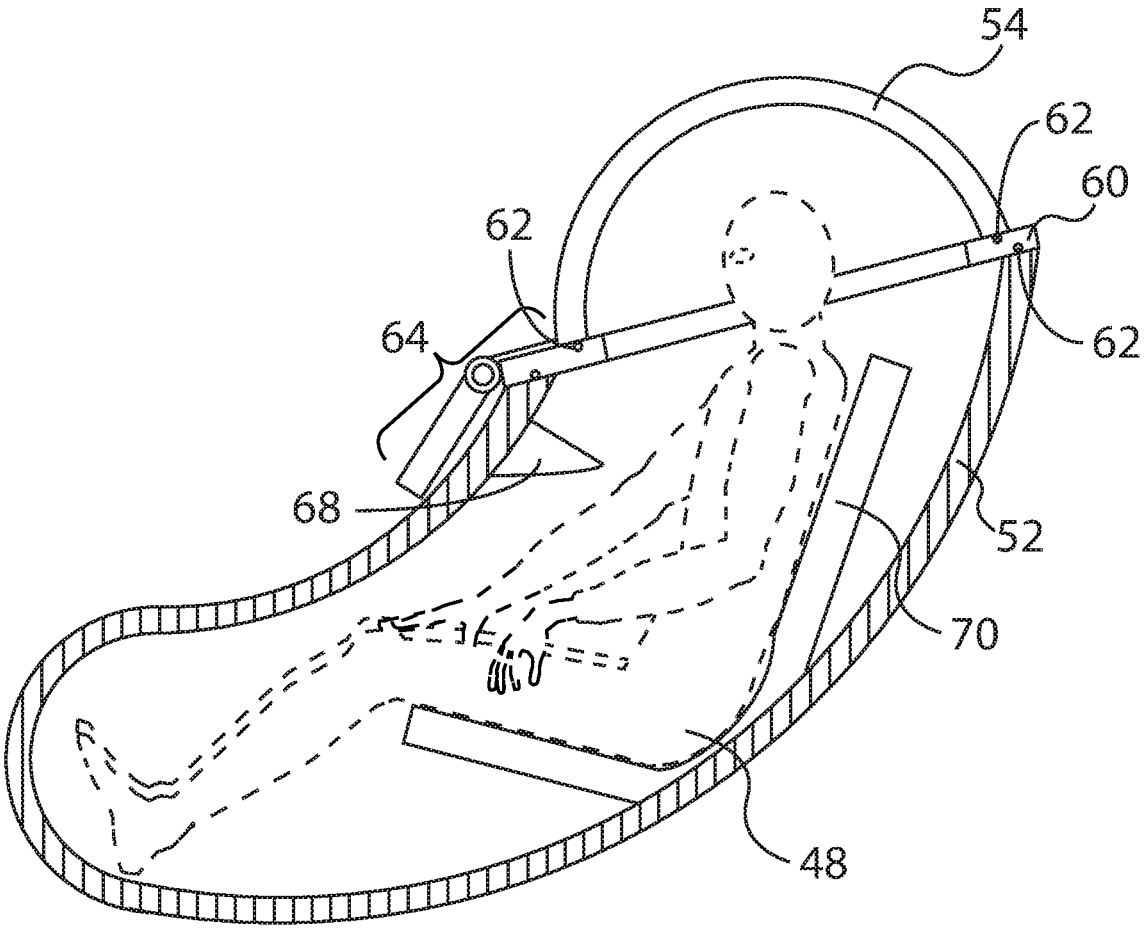
FIG. 12 is a side sectional view of the pod in FIG. 9 showing the interior of the pod.
Figure 13:
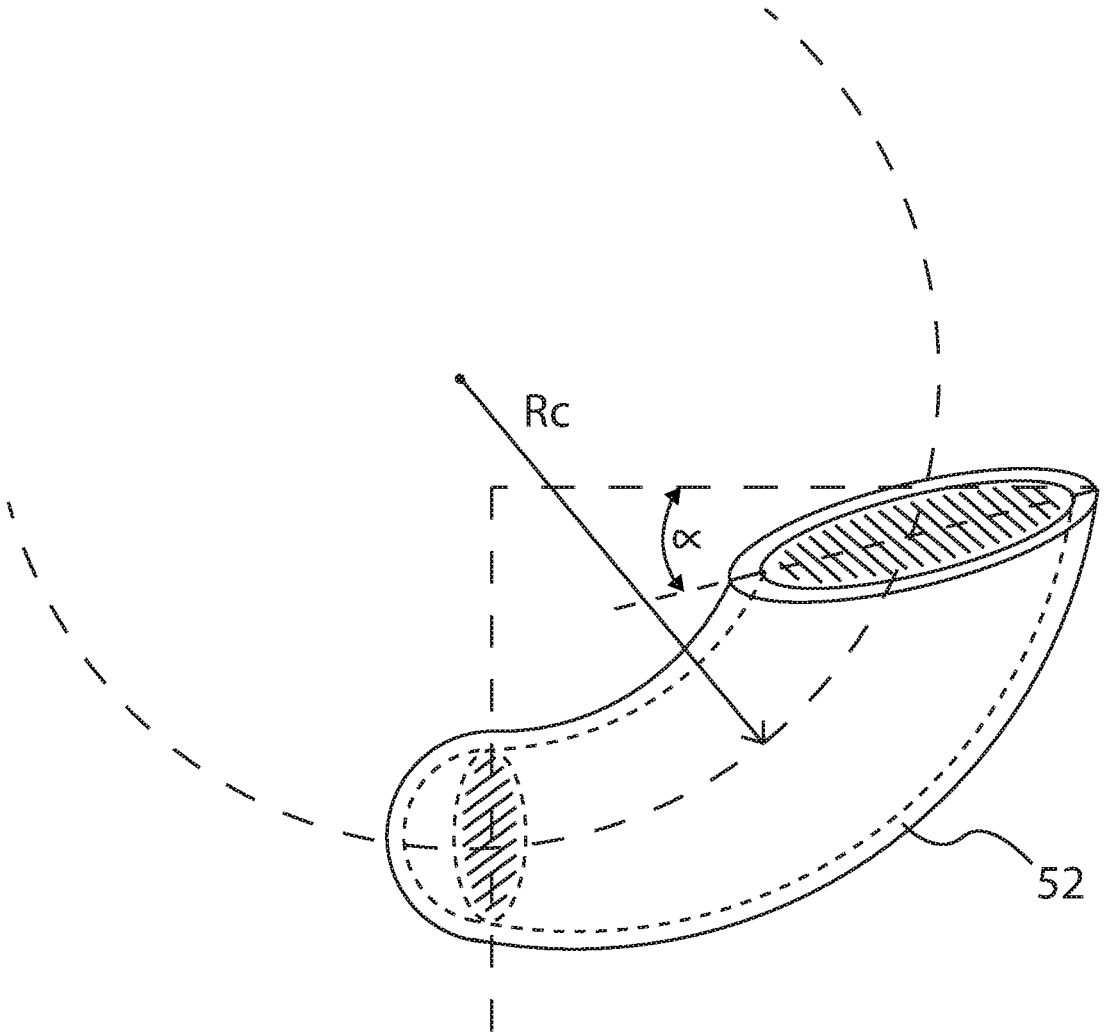
FIG. 13 is a detailed side-sectional view of the pod of FIG. 9 showing various critical parameters needed for the inexpensive manufacture of said pod.

A comparison is made of the viewing benefits of the present invention in FIG. 9 to a prior art invention in FIG. 8. A standard pressure hull, FIG. 8, is typically limited to about fifty-four inches internal diameter for two occupants to avoid excessive weight preventing occupants from straightening legs. The inability to straighten legs can become uncomfortable even alarming after time, a deficiency other types using pressure pods rather than conventional spherical pressure hulls have overcome. Also, the typical seating arrangement in a spherical acrylic pressure hull places occupants head close to the very top. Hence eyes are typically displaced far from the optical idea center of the acrylic sphere with zero optical distortion and thus the view to occupants suffers significant distortion.

FIG. 9 shows improvements to reduce distortion in the present invention. Viewing dome 54 is formed of an optically clear material. In general, viewing dome is a portion of a hemisphere. Viewing dome 54 is configured to maximize frontal downwards viewing area when the human body is in a seated position within the submersible pod. Generally the human eyes are located substantially at the center of dome 54 (it is critical the eyes are located within inner 25-percent) to provide minimal optical distortion.

The progressive widening of interior 56 of body portion 52 of pod 50 from foot end to seal end is essential to enable its manufacture in various materials (such as composites) and removal form a single male mold. The design also eliminates most of the metal work needed to only latching system 64. The design helps reduce manufacturing costs.

Other features contained with pod 50 are a life support system 66, a control panel 68 and a seat 70. When multiple pods are used and occupied by passengers, one or more control pods with controls for a pilot will be provided. For passenger pods the life support system needs to be automatic with critical data and control communicated to the pilot pod.

Pods 50 may be incorporated into other types of submersible vehicles. Some examples are shown in FIGS. 14-17.

Figure 14:
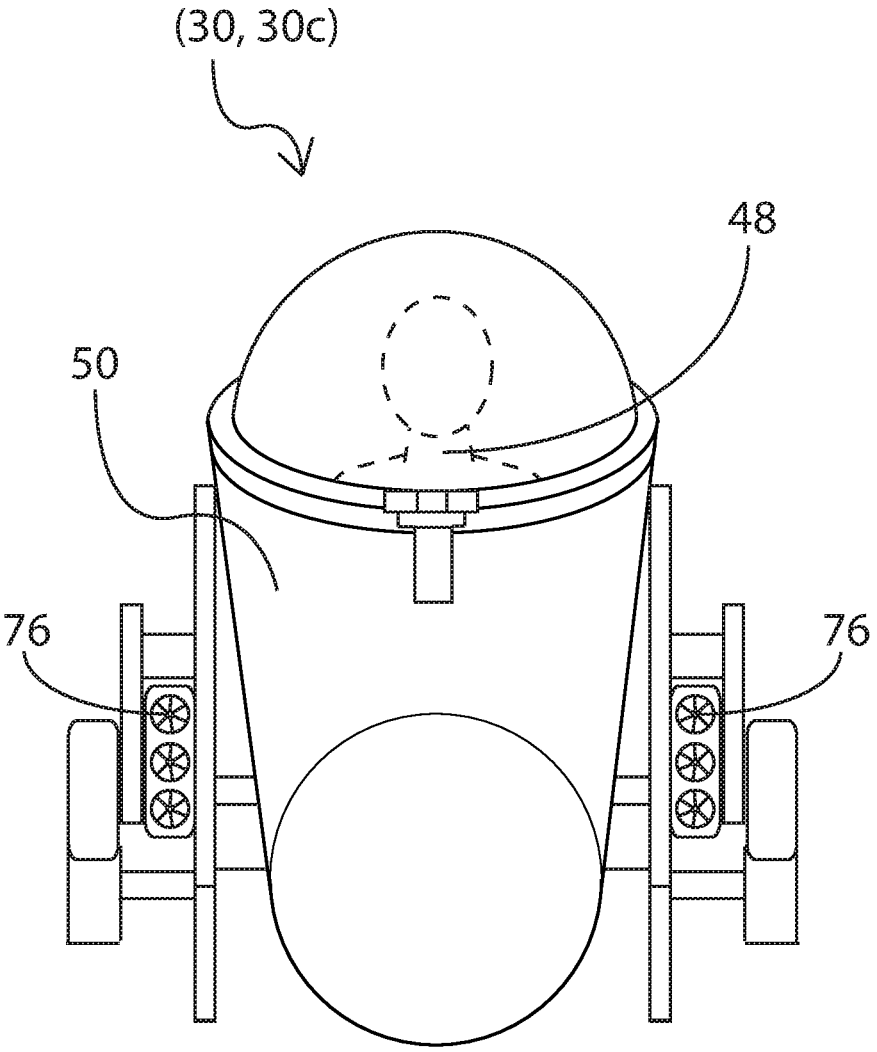
FIG. 14 is a front view of the pod of FIG. 9, now incorporated with one embodiment of a maneuvering pack to turn the pod into an autonomous submersible vehicle.
Figure 15:
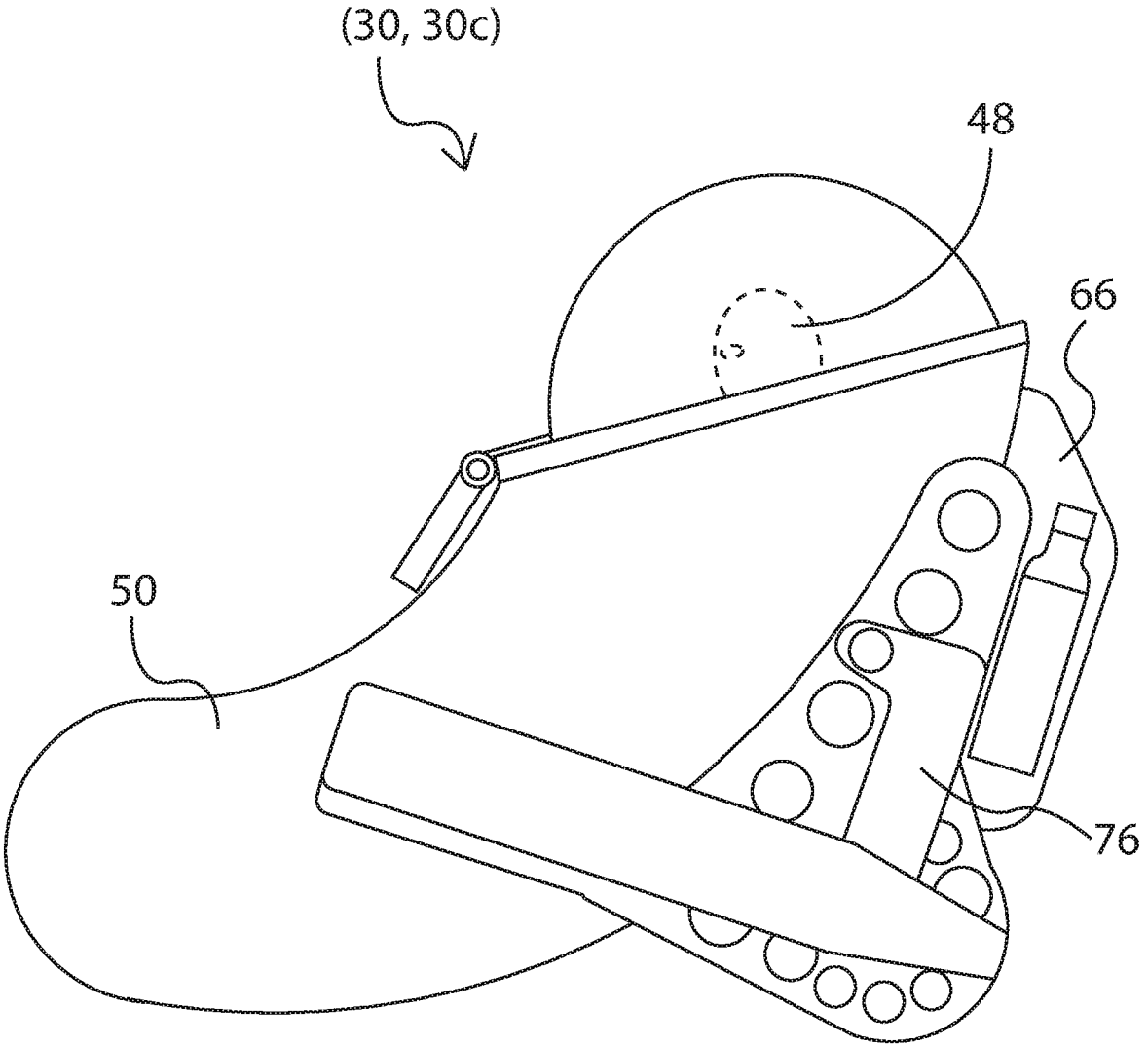
FIG. 15 is a side view of the pod and autonomous submersible vehicle in FIG. 14.
Figure 16:
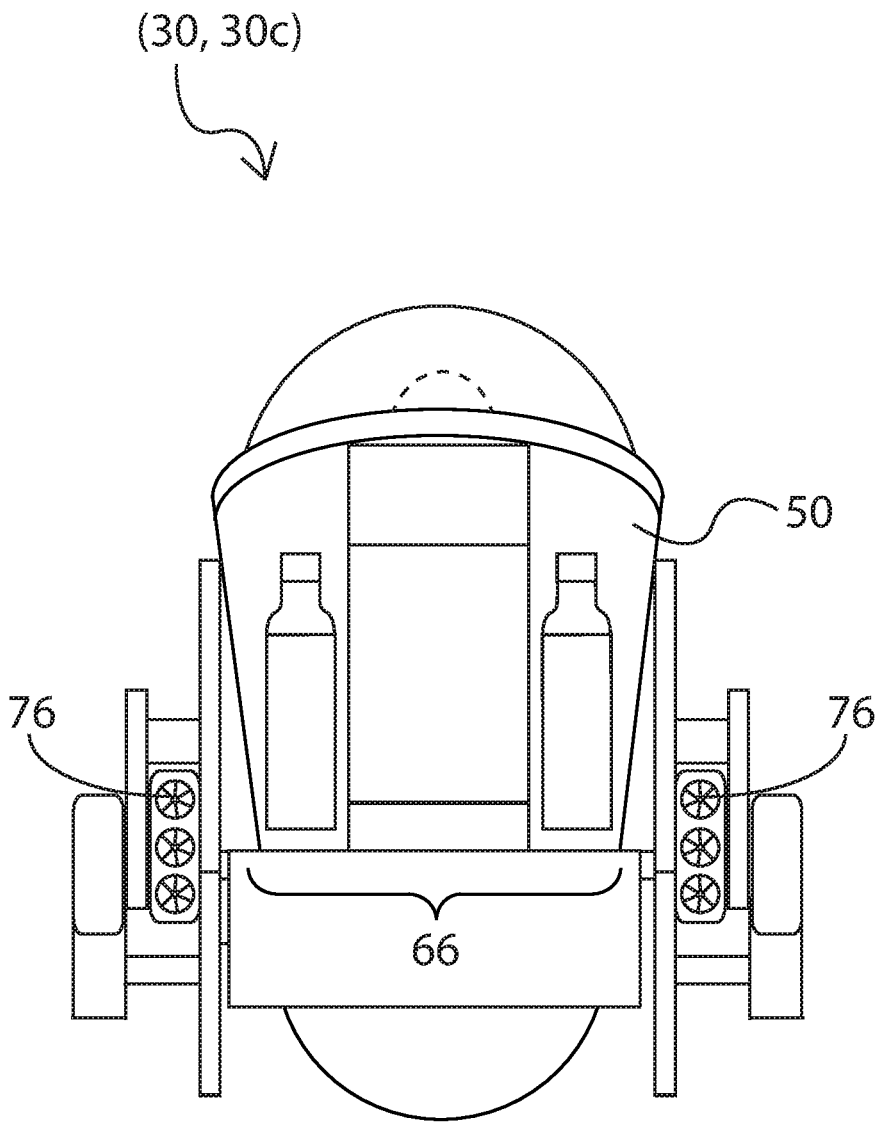
FIG. 16 is a back perspective view of the pod and autonomous submersible vehicle in FIG. 14.
Figure 17:
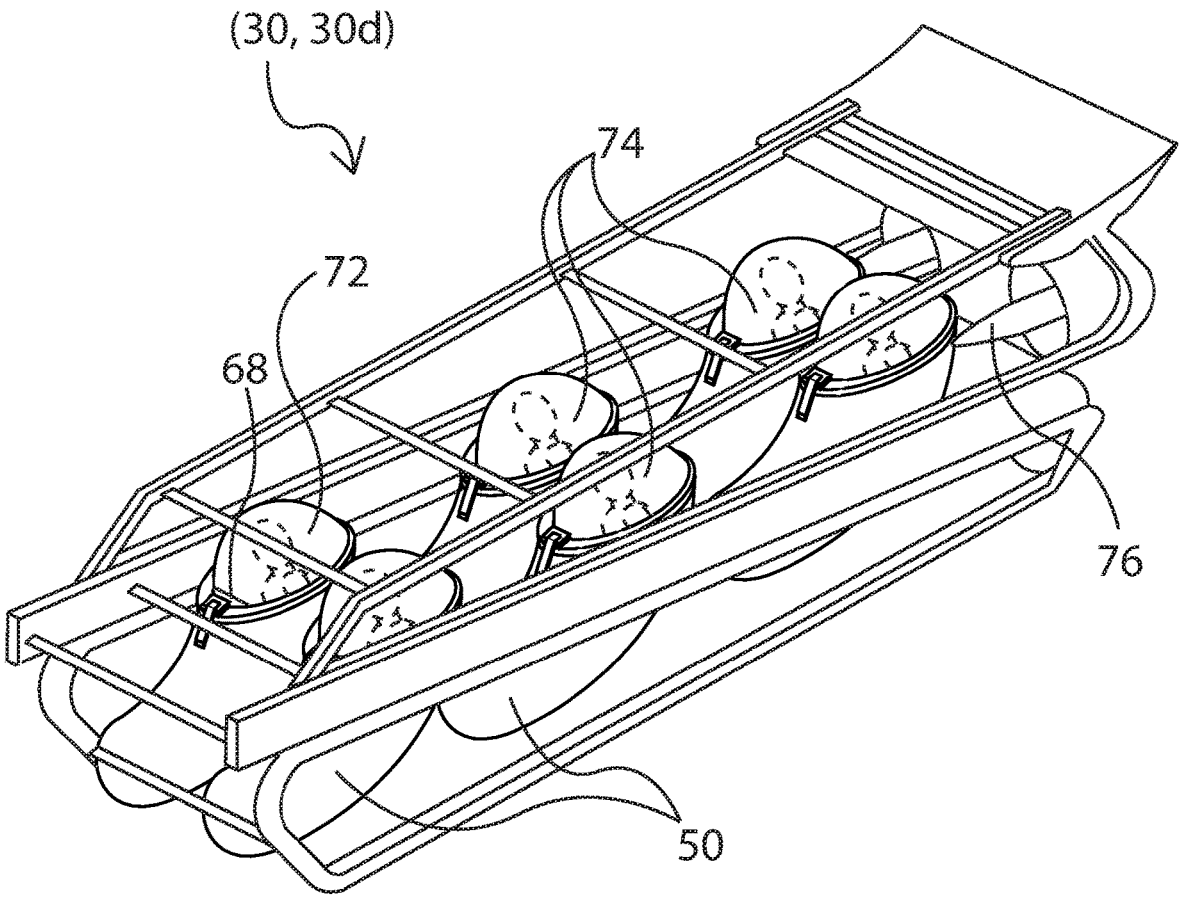
FIG. 17 is perspective view of a plurality of pods of FIG. 9, now incorporated with one embodiment of a frame to turn the pod into an autonomous submersible vehicle that can be driven by a pilot.

FIGS. 14-16 show a single pod 50 with a propulsion pack 76. FIG. 17 shows a multipod vehicle. In one embodiment a plurality of pods 50 are linked together so that all pods are partially contained within hydrodynamic shell to create a multi-pod submersible vehicle. In another embodiment the multi-pod submersible vehicle has a control pod 72 that includes controls for the multi-pod submersible vehicle and one or more occupancy pods 74. The advantage of mass production and certification of human occupied pods is lower cost on any type of vehicle using such a common modular system.

While several embodiments of the invention, together with modifications thereof, have been described in detail herein and illustrated in the accompanying drawings, it will be evident that various further modifications are possible without departing from the scope of the invention. The scope of the claims should not be limited by the preferred embodiments set forth in the examples, but should be given the broadest interpretation consistent with the description as a whole.

What is claimed is:

1. A water submersible vehicle, comprising:

a) a body having a center of gravity, center of buoyancy and a long axis;

b) at least one forward thruster located forward of the center of buoyancy and providing thrust substantially perpendicular to the long axis;

c) at least one main thruster located to provide propulsion thrust along the long axis;

d) at least one port wing and at least one starboard wing to control roll motion; and e) wherein the forward thruster adjusts pitch of the vehicle, wherein the forward thruster adjusts downward thrust of the vehicle at zero horizontal speed to control vertical movement and allow for hovering.

2. A water submersible vehicle as recited in claim 1, further comprising a variable pitch angle A, wherein pitch is controlled through the equation $T_F \cdot Xy = W \cdot SinA \cdot Xb$, wherein $T_F$ adjusts pitch angle A.

3. A water submersible vehicle as recited in claim 1, further comprising a variable buoyancy system.

4. A water submersible vehicle as recited in claim 1, further comprising a lift slot, wherein the forward thruster is contained within the lift slot.

5. A water submersible vehicle as recited in claim 1, further comprising a wedge-shaped nose that is wider in a direction perpendicular to the lift slot.

6. A water submersible vehicle as recited in claim 1, further comprising port and starboard fins to control roll motion.

7. A water submersible vehicle as recited in claim 1, wherein said at least one is a pair of main thrusters, wherein one of each main thrusters of the pair of main thrusters is located on the right and left side of the long axis, wherein said pair of propulsion thrusters control yaw.

8. A water submersible vehicle as recited in claim 1, further comprising a hydrodynamic shell.

9. A water submersible vehicle as recited in claim 1, further comprising a submersible pod having a generally bean-shaped shell for holding a human.

10. A water submersible vehicle as recited in claim 1, further comprising a control system.

11. A water submersible vehicle as recited in claim 10, wherein the control system includes a first control element and a second control element.

12. A water submersible vehicle as recited in claim 11, wherein each control element controls one or two motions from the group consisting of motion along long axis, yaw, pitch and roll.

13. A water submersible vehicle for holding a human body having eyes, comprising:

a) a pod having a body portion and a viewing dome, the body portion having a truncated bean-shaped shell, the pod having walls that define an interior and an exterior;

b) a seal between the body portion and the viewing dome;

c) a latching system for displacing the viewing dome from the body portion to allow the human body entry into and out of the submersible pod; and d) at least one port in the side wall of the body portion for allowing electronics to enter the pod when the viewing dome is sealed to the body portion.

14. A water submersible vehicle as recited in claim 13, wherein the pod is a bean-shape pod that minimizes volume of the pod to conform to the shape of a human body seated within the pod and at the same time provides for good hydrodynamic flow around the submersible pod.

15. A water submersible vehicle as recited in claim 13, wherein the body portion has center line, wherein the center line has a radius of curvature.

16. A water submersible vehicle as recited in claim 15, wherein the radius of curvature is constant.

17. A water submersible vehicle as recited in claim 15, wherein the radius of curvature is in the range of 20-inches to 80-inches.

18. A water submersible vehicle as recited in claim 13, wherein the body portion has a shell with shell length, a shell diameter, shell thickness, a seal end and a foot end.

19. A water submersible vehicle as recited in claim 18, wherein the shell diameter increases from the foot end to the seal end.

20. A water submersible vehicle as recited in claim 18, wherein the shell diameter to shell length is in the range of 1:3 to 1:4.

21. A water submersible vehicle as recited in claim 18, wherein the shell thickness increases from the foot end to the seal end along the front side.

22. A water submersible vehicle as recited in claim 13, wherein the viewing dome is formed of an optically clear material; wherein the viewing dome is a portion of a hemisphere.

23. A water submersible vehicle as recited in claim 22, wherein said viewing dome is configured to maximizes frontal viewing area when the human body is in a seated position within the submersible pod.

24. A water submersible vehicle as recited in claim 13, whereby when a human body is in a seated position within the pod the humans eyes are located substantially at the center of the dome to provide minimal optical distortion of objects viewed outside the viewing dome.

25. A water submersible vehicle as recited in claim 13, whereby when a human body is in a seated position with the pod, eyes are located within an inner 25-percent of the radius of the sphere.

26. A water submersible vehicle as recited in claim 13, further comprising a life support system.

27. A water submersible vehicle as recited in claim 13, further comprising a control system.

28. A water submersible vehicle as recited in claim 13, further comprising a seat located within the body portion.

29. A water submersible vehicle as recited in claim 13, further comprising a buoyancy system.

30. A water submersible vehicle as recited in claim 13, further comprising a propulsion system.

31. A water submersible vehicle as recited in claim 13, further comprising a hydrodynamic shell that said submersible pod fits within.

32. A water submersible vehicle as recited in claim 13, further comprising a plurality of pods linked together, wherein all pods partially contained within a hydrodynamic shell to create a multi-pod submersible vehicle.

33. A water submersible vehicle as recited in claim 32, wherein the multi-pod submersible vehicle has a control pod that includes controls for the multi-pod submersible vehicle and one or more occupancy pods.

34. A water submersible vehicle for holding a human body having eyes, comprising:

a) a plurality of pods each having a body portion and a viewing dome, the pod having walls that define an interior and an exterior;

b) a seal between the body portion and the viewing dome of each pod;

c) a latching system for displacing the viewing dome from the body portion to allow the human body entry into and out of each submersible pod; and d) wherein all pods are partially contained within a hydrodynamic shell to create a multi-pod submersible vehicle.

35. A water submersible vehicle as recited in claim 34, wherein the multi-pod submersible vehicle has a control pod that includes controls for the multi-pod submersible vehicle and one or more occupancy pods.

36. A water submersible vehicle for holding a human body having eyes, comprising:

a) a pod having a body portion and a viewing dome, the body portion having a truncated bean-shaped shell, the pod having walls that define an interior and an exterior, the body portion having a shell diameter, a seal end and a foot end, wherein the shell diameter increases from the foot end to the seal end;

b) a seal between the body portion and the viewing dome; and c) a latching system for displacing the viewing dome from the body portion to allow the human body entry into and out of the submersible pod.

* * * * *